United States Patent [19]

DeWitt

[11] 4,104,606

[45] Aug. 1, 1978

[54] DIMMER SWITCH WITH INSULATION HOUSING

[75] Inventor: Robert R. DeWitt, Slatington, Pa.

[73] Assignee: Lutron Electronics Co., Inc., Coopersburg, Pa.

[21] Appl. No.: 754,101

[22] Filed: Dec. 23, 1976

[51] Int. Cl.[2] ..... H01C 10/50

[52] U.S. Cl. ..... 338/198; 200/307; 338/179; 338/199; 338/200

[58] Field of Search ..... 338/172, 179, 198, 199, 338/200; 260/307, 315; 315/200, 291, DIG. 7

[56] References Cited

U.S. PATENT DOCUMENTS

| | | | |
|---|---|---|---|
| 3,746,923 | 7/1973 | Spira et al. | 378/179 X |
| 3,748,532 | 7/1973 | Rosenbaum | 338/198 X |

*Primary Examiner*—C. L. Albritton

*Attorney, Agent, or Firm*—Ostrolenk, Faber, Gerb & Soffen

[57] ABSTRACT

An in-line switch is provided for an electrical circuit where the in-line switch can be connected in the circuit through pairs of spaced stabs on opposite sides of the switch housing which can penetrate a conventional line cord and make electrical contact to conductors of the cord. A single pair of stabs can also be used. The in-line switch is totally enclosed by an insulation housing. An internal molded articulated structure is contained within the housing to support all switch components including a conductive chassis, an elongated linearly adjustable potentiometer, a sliding operating member, and power switch contact members. The articulated housing then receives the sliding member which actuates the potentiometer in order to operate the switch contacts and/or to dim load devices in series with the switch. The switch members are identical in construction and consist of flexible leaf members having contacts at one end thereof and stab elements at the other end thereof.

27 Claims, 14 Drawing Figures

FIG. 1.
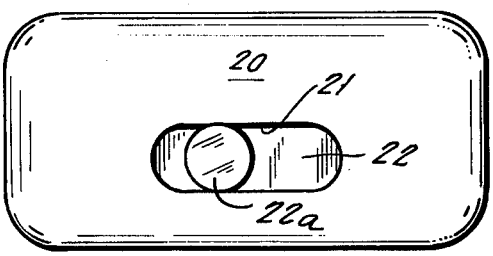
FIG. 4.
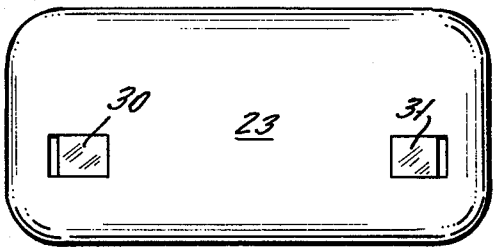
FIG. 2.
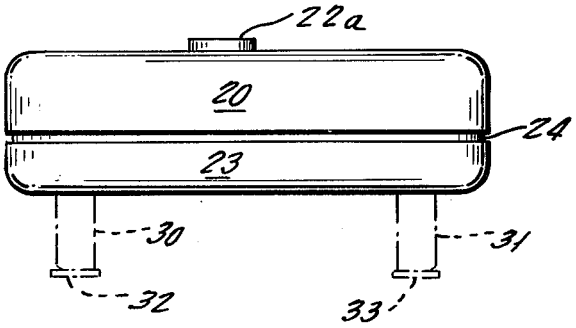
FIG. 3.
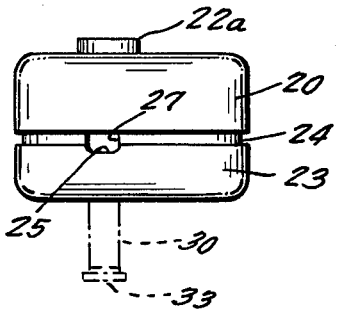
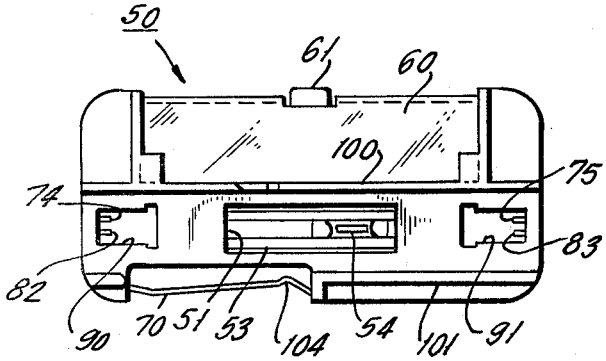
FIG. 5.
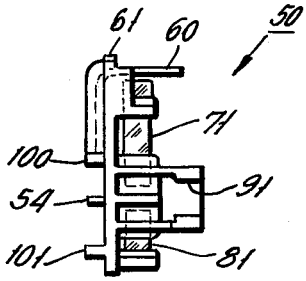
FIG. 7.
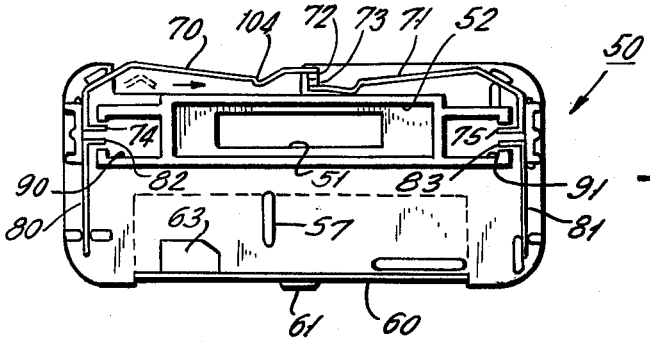
FIG. 6.

FIG. 8.
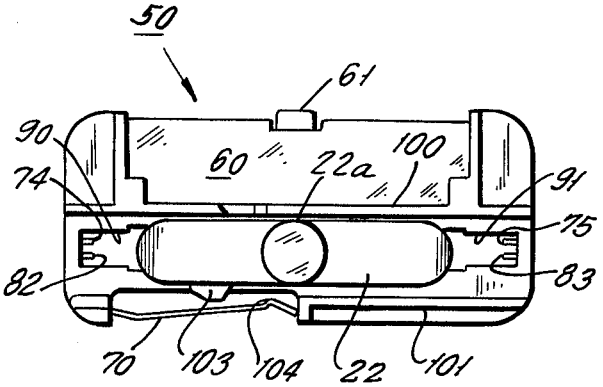
FIG. 9.
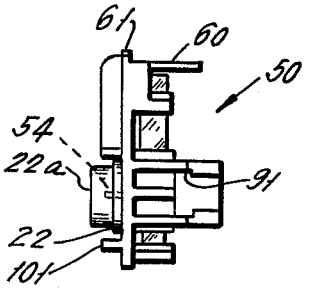
FIG. 14.
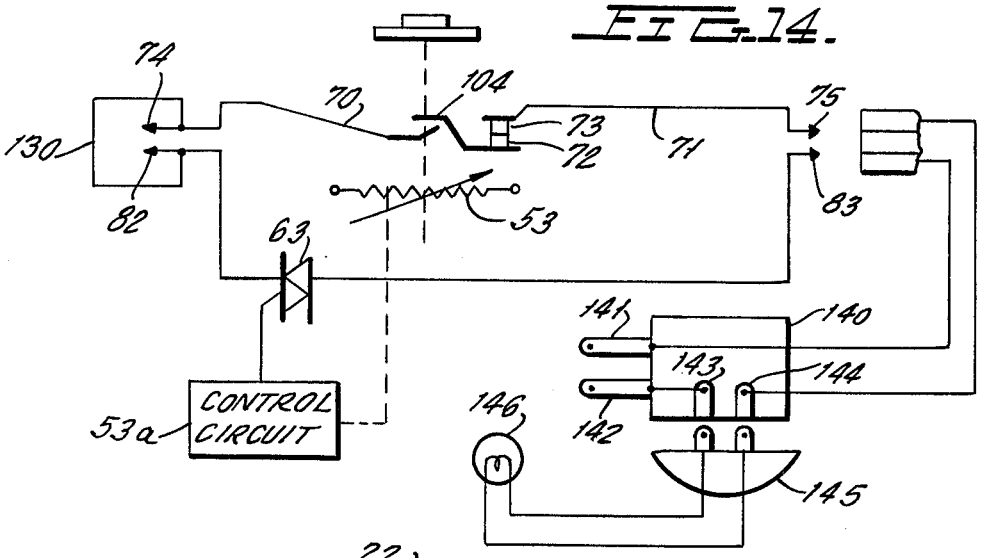
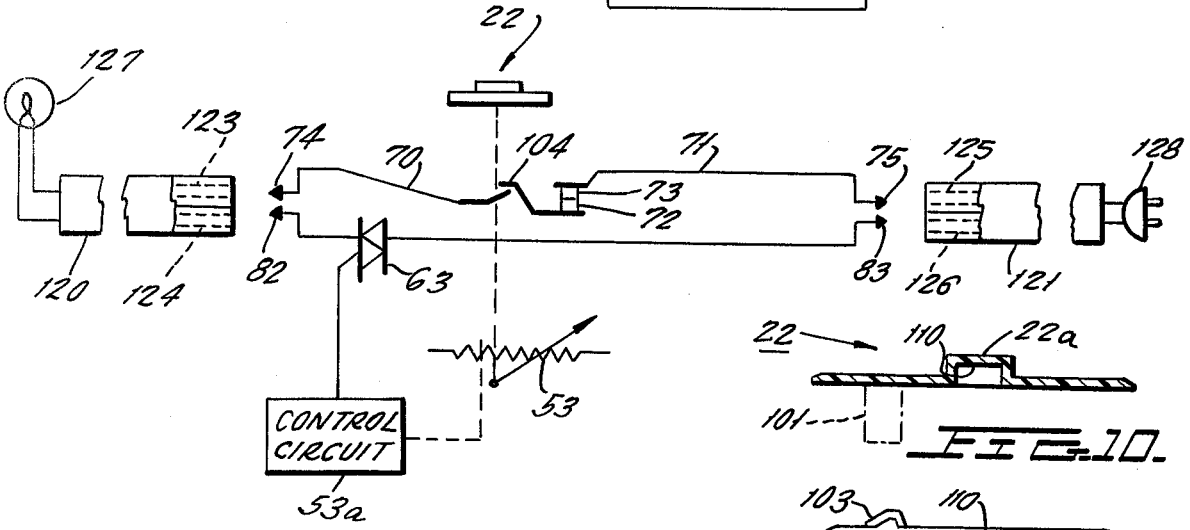
FIG. 13.
FIG. 10.
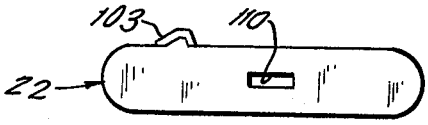
FIG. 11.

DIMMER SWITCH WITH INSULATION HOUSING

BACKGROUND OF THE INVENTION

This invention relates to a novel in-line switch, and more specifically relates to a novel in-line switch device having dimming capability and which can be manufactured at low cost. In-line switch devices are well known for household use and the like, and generally consist of a switch element which can be inserted into a power line cord in any of several manners, as by connection to threaded terminals or the connection to stab-type terminals which penetrate the conductor insulation to engage the internal power line conductors. In-line switches are also generally known where the devices are provided with dimming capability through the inclusion of a potentiometer controlled dimming circuit in the switch.

Dimming switches adapted to be contained in a wall are also known wherein the dimmer switch has a linearly actuated potentiometer. Such switches are shown in U.S. Pat. No. 3,746,923, entitled DIMMER SWITCH WITH LINEARLY MOVABLE CONTROL, in the names of Joel S. Spira and Joseph Licata, and assigned to the assignee of the present invention. The switch shown in the above U.S. patent is principally for a wall-mounted switch and cannot be usefully modified for use as an in-line switch.

Presently available in-line dimming switches are unreliable and are difficult to install and to operate.

BRIEF DESCRIPTION OF THE INVENTION

The principal of the present invention is to provide a novel in-line switch which may have dimming capability wherein the switch construction is simple and inexpensive and yet provides extremely reliable operation and can be easily installed and operated.

In accordance with this invention, a novel switch structure is provided wherein all switch components are carried on a molded articulated structure which has an elongated channel therein for receiving an elongated potentiometer. The articulated support further has means for receiving a small thermally conductive chassis which serves as a mount and heat sink for controllably conductive devices such as triacs or thyristors or the like which are used to provide dimming capability for the switch.

A volume is then defined within the articulated housing between the elongated potentiometer housing wall and the chassis for receiving other electrical components. The side wall of the molded articulated housing is provided with integral molding projections which enable the mounting of two contact spring blades which may be identical and which each have one end terminated with a cooperating contact and another end terminated with a sharp inwardly bent stab element. The spring member contact ends are biased toward one another in order normally to close a circuit and the spring blades may be biased apart to an open position by a movable slider operating member which has an operating cam projection disposed beneath one of the contact blades. This operating member is then operable such that it moves the linear potentiometer adjustment over the greatest portion of its linear travel without affecting the contacts. At the end of the linear travel of the operating member it engages and opens the contacts of the spring blade contact elements.

Two short conductive sections are then provided adjacent the stab ends of the two spring contacts, and these two short sections are provided with a second respective stab member for cooperating with the stab end of its respective spring contact. These pairs of stabs are contained within a respective well which receives a cam plunger which is carried in the outer housing. The two cam plungers may then be forced into the well containing the pairs of stabs in order to force the stabs through the insulation covering of a line which is inserted into the well before the cam plungers are operated. Other stab configurations and connection systems could also be used.

The molded articulated structure which carries all of the switch components is then contained within the two halves of an enclosing switch housing wherein the bottom half of the housing carries the cam plungers referred to above, while the upper half of the housing contains a slot therein to provide access to the sliding operating member which engages the contact switch and the potentiometer.

The two halves have snapped together or can be otherwise secured together in any desired manner. The resulting structure is one which is inexpensively manufactured and is easily installed by the user and is reliable in operation.

If desired, the in-line switch may be used only for switching capability, with the dimmer components removed, or may be used only for its dimming capability, with the switching components removed. Similarly, the switch can be adapted for use with only a single set of stabs or terminals.

BRIEF DESCRIPTION OF THE DRAWINGS

FIG. 1 is a top view of the assembled in-line switch of the present invention.

FIG. 2 is a front elevation view of FIG. 1.

FIG. 3 is an end view of FIG. 1.

FIG. 4 is a bottom view of FIG. 1.

FIG. 5 is a top view of the molded articulated structure with a few components in position.

FIG. 6 is a bottom view of the molded articulated structure of FIG. 5.

FIG. 7 is an end view of FIG. 5.

FIG. 8 is a view similar to FIG. 5 but further showing the actuated slider in position on the molded articulated structure.

FIG. 9 is a view of FIG. 8 as seen from the right-hand end thereof.

FIG. 10 is a cross-sectional view of the slider shown in position in FIGS. 8 and 9.

FIG. 11 is a bottom view of the slider of FIG. 10 to illustrate its actuating cam.

FIGS. 13 and 14 are electrical schematic diagrams of the basic circuit components of the in-line switch of the present invention.

DETAILED DESCRIPTION OF THE DRAWINGS

Figure 12:
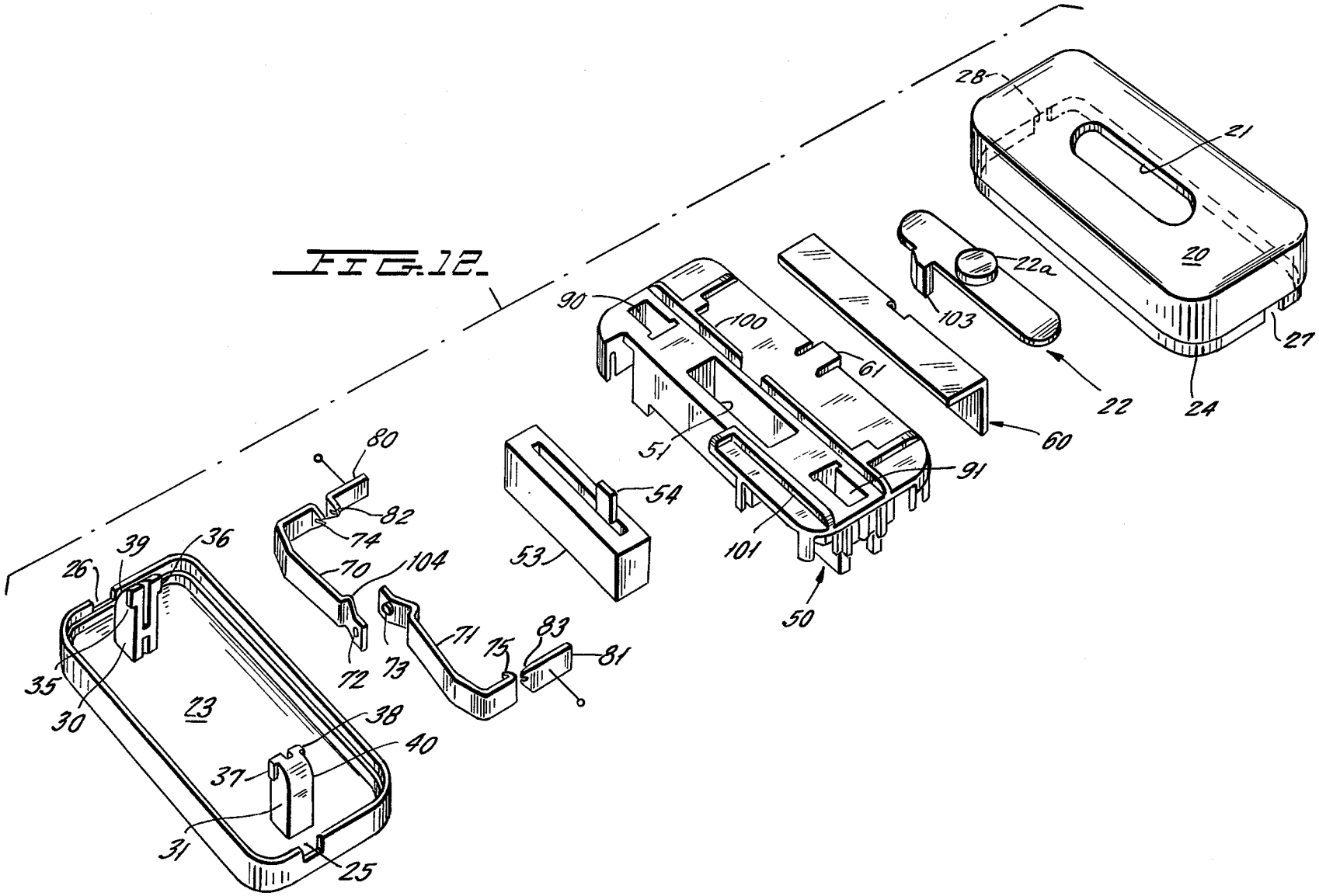
FIG. 12 is an exploded perspective view of the entire assembly of the components of FIGS. 1 to 11.

Referring first to FIGS. 1 to 4 and 12, there is shown therein an in-line switch structure consisting of an upper molded housing half 20 which has an elongated opening 21 therein. OPening 21 receives the projecting handle **22*a* of an elongated operating slider 22 (FIGS. 10 and 11**) which operates both the switch and the dimmer when dimming capability is provided for the switch.

The outer housing for the switch is completed by a bottom housing half molding 23 which engages upper housing half 20 through a frictional engagement with a telescoping flange 24 of the upper half 20 which enters into the opposing interior of lower half 23. If desired, ribs can be provided (not shown) to provide a snap-connection between upper half 20 and lower half 23 when the two are forced together.

As seen in FIGS. 3 and 12, the lower half 23 is provided with notches 25 and 26 which are aligned with similar notches, such as notch 27 (FIG. 3) and 28 (FIGS. 3 and 12), respectively. The two opposing notch members 25–27 and 26–28 define windows in the opposite ends of the in-line switch housing which can receive the clipped end of an insulated line cord which is to be connected to the switch in a manner to be described hereinafter. Note that the connection of the line cord members will be obtained through the provision of cam plunger members 30 and 31 which are loosely held within openings in the bottom housing 23. Other connection systems can be used.

Cam plunger members 30 and 31 shown in dotted-line extended position in FIGS. 2 and 3, have extending heads 32 and 33 which prevent them from being separated from housing half 23 by passing through their receiving slots in housing 23. Members 30 and 31 also have short projecting ears 35–36 and 37–38, respectively (FIG. 12) which prevents them from falling out of the housing 23. As will be later seen, each of the plunger members 30 and 31 have camming surfaces 39 and 40, respectively, which can engage the end of a wire inserted into the windows created by notches 25–27 and 26–28 when electrical connection is to be made to the switch.

The upper and lower halves 20 and 23 of the housing then contains between them a molded articulated structure 50, shown in detail in FIGS. 5 to 9 and 12. The molded articulated structure 50, as shown for example in FIG. 12, contains an opening 51 which leads to a molded well 52 (FIG. 6) which well 52 receives an elongated potentiometer 53, shown in FIGS. 5 and 12 (the potentiometer is not in place in FIG. 6 for purposes of clarity).

The potentiometer 53 has an elongated slider control member 54 which enables the change in resistance of the potentiometer for any desired control function and will be later described. The region below the lower wall defining well 52 in FIG. 6 is also shown as containing a molded baffle 57 which enables the mounting below well 52 of various electrical components which are used in the control circuit of the dimmer portion of the switch.

The molded articulated structure 50 next receives a generally L-shaped conductive chassis 60 which is centered thereon by an extending tongue 61 of the molded articulated structure 50 which extends through a slot in the chassis 60. The metal chassis 60 may then receive semiconductive control means such as a triac 63, as shown in FIG. 6, where triac 63 may serve as the control component for the dimmer operation of the device. Clearly, other components can be used, such as thyristors or the like, in place of the triac 63. Note further that all of the control circuit components for the triac 63 will be located adjacent thereto in the region between well 52 and chassis 60 in FIG. 6.

The molded articulated support structure 50 then receives around one edge thereof a pair of conductive spring contacts 70 and 71 which are identical in configuration (but may be differently configured) and which are terminated at one end by contact elements 72 and 73, respectively (FIGS. 6 and 12), and at their other end by the inwardly projecting stab elements 74 and 75, respectively. These spring contact members 70 and 71 are held in position on the molded articulated structure 50 by suitable integrally molded projections of molding 50 with the contacts 72 and 73 being under tension such that they are normally biased closed by the spring forces of the members 70 and 71.

Short conductive spring sections 80 and 81 are also provided, as best shown in FIGS. 6 and 12, and are held on the end of the molded articulated body 50 by support projections which extend integrally from body 50. Spring sections 80 and 81 are each terminated with respective stabs 82 and 83 which cooperate with stabs 74 and 75, respectively, as shown. It is to be noted that the ends of spring contact members 70 and 71 and 80 and 81 are arranged to project into lateral channels 90 and 91 which are formed through housing 50, and lateral channels 90 and 91 are positioned to receive cam plungers 30 and 31, respectively. Thus, in order to connect the clipped end of an insulated wire to the switch, one inserts the wire through the window, such as the window formed in FIG. 3 between notches 25 and 27 into and just below the bottom of channel 91. The plunger 31 is moved upwardly, thereby forcing the insulated conductor to bend against the right-hand wall of channel 91 in FIG. 6 and thus causing the stabs 75 and 83 to pierce the insulated conductor and engage the conductors within the insulation. A similar action is used to cause a wire to engage the stabs 74 and 82 on the opposite side of the in-line switch structure.

The articulated support housing 50 further receives the slider operating member 22 of FIGS. 10 and 11, as shown specifically in FIGS. 8 and 9. The operating projection **22*a* of slider 22 projects through slot 21 and the slider 22 is confined to linear motion by the integral walls 100 and 101 of the molded housing 50**.

As is further shown in FIGS. 8, 10, 11 and 12, the slider 22 has a downwardly extending integral cam member 103 which is positioned between the edge of the upper platform of molded articulated housing 50 and the contact blade 70, such that the slider 22 may move a considerable distance without affecting the position of contact 70 but, when it engages cooperating cam region 104 of contact strip 70, it will press the contact strip 70 outwardly to open the contact between contacts 72 and 73. At the same time, the slider 22 contains an interior slot 110, as best shown in FIGS. 10 and 11, where the slot 110 receives projection 54 of the potentiometer 53. Consequently, as the slider 22 moves along the guiding channels of the molded articulated housing 50, it will operate the potentiometer over a wide range of travel (thereby to obtain dimming of a lamp which may be connected to the switch) and, when slider 22 approaches the end of its travel, its cam 101 engages region 104 of contact strip 70 to cause the opening of the contacts and thus the opening of the switch.

FIG. 13 is a circuit diagram of the major components of the switch described above. Thus, in FIG. 13, there is schematically illustrated the spring contacts 70 and 71 and their contact elements 72 and 73, respectively, which are shown in engagement. Also shown in FIG. 13 are the stab endings 74 and 75 of spring contacts 70 and 71, respectively, as well as the spaced stabs 82 and 83 of contact strip sections 80 and 81, respectively, which cooperate with stabs 74 and 75, respectively.

As further shown in FIG. 13, a circuit is completed between stabs 82 and 83 which includes the triac 63. As schematically illustrated in FIG. 13, the potentiometer 53 is connected to a control circuit 53*a* which can be housed in the region of FIG. 6 between the lower wall of well 52 and the chassis 60. Thus, adjustment of potentiometer 53 will cause an appropriate control of control circuit 53*a*, thereby to adjust the firing point of triac 63 in order to control the power transmitted by the switch. The adjustment of potentiometer 53 and the subsequent opening of contacts 72 and 73 is then controlled by the slider 22, schematically shown in FIG. 13.

FIG. 13 illustrates the manner in which the novel in-line switch can be connected in the power line of a lamp or the like which is to be controlled by the switch. Thus, a conventional insulated line containing two conductors is simply cut across its thickness to define the two sections 120 and 121, shown in FIG. 13. Note that these two sections are schematically illustrated as containing conductors 123–124 and 125–126, respectively, which are covered with insulation. Thus, conductor ends are then inserted into the openings at either end of the housing and cam plungers 30 and 31 are operated as previously described to make connection between conductors 123 and 124, with stabs 74 and 82, respectively, and between conductors 125 and 126 and stabs 75 and 83, respectively. The conductors 123 and 124 may then be connected directly to the appliance such as a lamp or the like, as schematically illustrated by the lamp 127, while the terminals of conductors 125 and 126 may be connected to a suitable line plug 128 which is connected to an appropriate voltage source for energizing the lamp 127 through the switch and dimmer combination of the invention.

In the circuit shown in FIG. 13, the device is shown as having separate terminals 74–82 and 75–83 for connection in series with a severed line. This circuit can be modified as shown in FIG. 14, wherein the structure provides only a single set of stab terminals 75 and 83 while the stab terminals 74 and 82 are directly connected to one another by a short length of wire 130. The internal structure of the switch and dimmer device, however, is identical to that previously described.

The novel device of FIG. 14 can then be used with a special split plug power cord of a well-known type so that the device can be used as a table top dimmer or switch or combined dimmer and switch device. The power cord for the device is schematically illustrated in FIG. 14 as consisting of a split plug 140 which contains schematically illustrated male prongs 141 and 142 which are connected to a conventional wall outlet. The plug also contains a female type receptacle which includes female elements 143 and 144 which are connected in series with the power line cord. A conventional line cord plug 145, which may be connected, for example, to a lamp or other appliance 146, is then plugged into receptacle 143–144 and the power applied to the lamp or appliance 146 may then be switched on and off and/or dimmed by the switching device of the invention.

In the foregoing, a particular stab arrangement has been shown which has particular convenience in use. However, other stab configurations and other terminal configurations could be used in connection with the device disclosed herein.

Although preferred embodiments of this invention have been described, many variations and modifications will now be apparent to those skilled in the art, and it is therefore preferred that the instant invention be limited not by the specific disclosure herein but only by the appended claims.

The embodiments of the invention in which an exclusive privilege or property is claimed and defined as follows:

1. An in-line switch for an electrical circuit comprising, in combination:

a housing for enclosing said in-line switch;

an externally operable operating member extending through said housing;

a pair of cooperating contacts operable by said operating member and operated thereby between engaged and disengaged positions;

first and second pairs of terminals positioned at opposite sides of said housing, said first and second pairs of terminals each comprising first and second spaced conductive stabs disposed in respective first and second elongated channels;

and first and second plunger means being movable in said first and second channels and being adapted to force parallel-disposed insulated wires into engagement with said first and second stabs respectively of said first and second pairs of terminals respectively;

said first stabs of said first and second pairs of stabs being connected to one another;

said second stabs of said first and second pairs of stabs being connected to respective ones of said pairs of contacts.

2. The in-line switch of claim 1 which further includes controllably conductive means connected between said first stabs, and adjustment means for operating said controllably conductive means from regions external of said housing.

3. The in-line switch of claim 2 wherein said operating member is a slide member operatively connected to said adjustment means; said operating member having a cam member extending therefrom and being engageable with said pair of cooperating contacts before said slide member reaches one end of its travel.

4. The in-line switch of claim 1 which further includes first and second identical conductive spring members; said contacts of said pair of cooperating contacts being mounted on one end of a respective one of said conductive spring members; said one end of said first and second conductive spring members being adjacent one another; the opposite ends of said first and second conductive spring members terminating with stabs which define said second stabs of said first and second pairs of stabs respectively.

5. The in-line switch of claim 4 which further includes controllably conductive means connected between said first stabs, and adjustment means for operating said controllably conductive means from regions external of said housing.

6. The in-line switch of claim 5 wherein said operating member is a slide member operatively connected to said adjustment means; said operating member having a cam member extending therefrom and being engageable with said pair of cooperating contacts before said slide member reaches one end of its travel.

7. The in-line switch of claim 1 which further includes a molded articulated support member and first and second housing halves which enclose said articulated support member; said first and second terminals, said operating member, and said pair of contacts being mounted on said articulated support member.

8. The in-line switch of claim 7 which further includes first and second identical conductive spring members; said contacts of said pair of cooperating contacts being mounted on one end of a respective one of said conductive spring members; said one end of said first and second conductive spring members being adjacent one another; the opposite ends of said first and second conductive spring members terminating with stabs which define said second stabs of said first and second pairs of stabs respectively.

9. The in-line switch of claim 8 which further includes controllably conductive means connected between said first stabs, and adjustment means for operating said controllably conductive means from regions external of said housing.

10. The in-line switch of claim 9 wherein said operating member is a slide member operatively connected to said adjustment means; said operating member having a cam member extending therefrom and being engageable with said pair of cooperating contacts before said slide member reaches one end of its travel.

11. The in-line switch of claim 2 wherein said adjustment means comprises an elongated linear potentiometer.

12. The in-line switch of claim 11 wherein said articulated housing includes an elongated insulated well for receiving said elongated potentiometer.

13. The in-line switch of claim 12 wherein said articulated housing includes said first and second elongated channels; said first and second channels being disposed on opposite sides of said elongated insulated well.

14. An in-line dimmer for an electrical circuit comprising, in combination;

a housing;

an externally operable operating member extending through said housing;

first and second pairs of terminals positioned at opposite sides of said housing;

a controllably conductive means and adjustment means for operating said controllably conductive means; said adjustment means connected to said externally operable operating member;

said first and second pairs of terminals each comprising first and second spaced conductive stabs disposed in respective first and second elongated channels;

and first and second plunger means being movable in said first and second channels and being adapted to force parallel-disposed insulated wires into engagement with said first and second stabs respectively of said first and second pairs of terminals respectively;

said first stabs of said first and second pairs of stabs being connected to one another;

said second stabs of said first and second pairs of stabs being connected in series with said controllably conductive means.

15. The in-line dimmer of claim 14 which further includes a molded articulated support member and first and second housing halves which enclose said articulated support member; said first and second terminals, said operating member, said adjustment means, and said controllably conductive means being mounted on said articulated support member.

16. An in-line switch for an electrical circuit comprising, in combination:

a housing for enclosing said in-line switch;

an externally operable operating member extending through said housing;

a pair of cooperating contacts operable by said operating member and operated thereby between engaged and disengaged positions;

first and second pairs of terminals positioned at opposite sides of said housing;

said first and second pairs of terminals each comprising first and second spaced conductive stabs;

and connection means adapted to force parallel-disposed insulated wires into engagement with said first and second stabs respectively of said first and second pairs of terminals respectively;

said first stabs of said first and second pairs of stabs being connected to one another;

said second stabs of said first and second pairs of stabs being connected to respective ones of said pair of contacts.

17. The in-line switch of claim 16 which further includes controllably conductive means connected between said first stabs, and adjustment means for operating said controllably conductive means from regions external of said housing.

18. The in-line switch of claim 17 wherein said operating member is a slide member operatively connected to said adjustment means; said operating member having a cam member extending therefrom and being engageable with said pair of cooperating contacts before said slide member reaches one end of its travel.

19. The in-line switch of claim 16 which further includes first and second identical conductive spring members; said contacts of said pair of cooperating contacts being mounted on one end of a respective one of said conductive spring members; said one end of said first and second conductive spring members being adjacent one another; the opposite ends of said first and second conductive spring members terminating with stabs which define said second stabs of said first and second pairs of stabs respectively.

20. The in-line switch of claim 16 which further includes a molded articulated support member and first and second housing halves which enclose said articulated support member; said first and second terminals, said operating member, and said pair of contacts being mounted on said articulated support member.

21. An in-line dimmer for an electrical circuit comprising, in combination:

a housing;

an externally operable operating member extending through said housing;

first and second pairs of terminals positioned at opposite sides of said housing;

a controllably conductive circuit means and adjustment means for operating said controllably conductive circuit means; said adjustment means connected to said externally operable operating member;

said first and second pairs of terminals each comprising first and second spaced conductive stabs;

and connection means adapted to force parallel-disposed insulated wires into engagement with said first and second stabs respectively of said first and second pairs of terminals respectively;

said first stabs of said first and second pairs of stabs being connected to one another;

said second stabs of said first and second pairs of stabs being connected in series with said controllably conductive circuit means.

22. The in-line dimmer of claim 21 which further includes a molded articulated support member and first and second housing halves which enclose said articulated support member; said first and second terminals, said operating member, said adjustment means, and said controllably conductive circuit means being mounted on said articulated support member.

23. An in-line switch for an electrical circuit comprising, in combination:

a housing for enclosing said in-line switch;

an externally operable operating member extending through said housing;

a pair of cooperating contacts operable by said operating member and operated thereby between engaged and disengaged positions;

first and second pairs of terminals positioned at opposite sides of said housing;

at least one pair of terminals which comprises first and second spaced stabs disposed in an elongated channel;

and plunger means movable in said elongated channel and being adapted to force parallel disposed insulated wires into engagement with said first and second stabs;

said first and second stabs being connected in series with said pair of cooperating contacts.

24. The in-line switch of claim 23 which further includes controllably conductive means connected between said first stabs, and adjustment means for operating said controllably conductive means from regions external of said housing.

25. The in-line switch of claim 24 wherein said operating member is a slide member operatively connected to said adjustment means; said operating member having a cam member extending therefrom and being engageable with said pair of cooperating contacts before said slide member reaches one end of its travel.

26. The in-line switch of claim 23 which further includes first and second identical conductive spring members; said contacts of said pair of cooperating contacts being mounted on one end of a respective one of said conductive spring members; said one end of said first and second conductive spring members being adjacent one another; the opposite ends of said first and second conductive spring members terminating with stabs which define said second stabs of said first and second pairs of stabs respectively.

27. An in-line dimmer for an electrical circuit comprising, in combination:

a housing;

an externally operable member extending through said housing;

first and second pairs of terminals positioned at opposite sides of said housing;

a controllably conductive circuit means and adjustment means for operating said controllably conductive circuit means; said adjustment means connected to said externally operable operating member;

at least one pair of terminals which comprises first and second spaced stabs disposed in an elongated channel;

and plunger means movable in said elongated channel and being adapted to force parallel disposed insulated wires into engagement with said first and second stabs;

said first and second stabs being connected in series with said controllably conductive circuit means.

* * * * *